United States Patent [19]

Niekrasz et al.

[11] 4,430,770

[45] Feb. 14, 1984

[54] DOOR OPERATING MECHANISM

[75] Inventors: Frank M. Niekrasz, Homewood; Matthew Rolek, Chicago, both of Ill.

[73] Assignee: Ardco, Inc., Chicago, Ill.

[21] Appl. No.: 306,314

[22] Filed: Sep. 28, 1981

[51] Int. Cl.[3] ..... E05F 1/10

[52] U.S. Cl. ..... 16/80; 16/70; 16/297; 16/332; 16/348; 16/349; 16/374; 16/DIG. 17; 49/386; 292/338; 292/DIG. 49

[58] Field of Search ..... 49/386, 394; 16/70, 16/65, 78, 80, DIG. 7, 82, DIG. 9, 84, DIG. 10, 85, DIG. 17, 67, 50, 365, 371, 344, 348, 317, 374, 278, 279, 297, 332, 349; 292/262, 338, DIG. 49

[56] References Cited

U.S. PATENT DOCUMENTS

| | | | |
|---|---|---|---|
| 1,221,528 | 4/1917 | Golding | 16/278 X |
| 1,721,257 | 7/1929 | Myers | 292/338 |
| 4,104,761 | 8/1978 | Lyons | 16/84 |

FOREIGN PATENT DOCUMENTS

| | | | |
|---|---|---|---|
| 581078 | 9/1946 | United Kingdom | 16/65 |
| 1435081 | 5/1976 | United Kingdom | 16/82 |

*Primary Examiner*—Mark Rosenbaum

*Attorney, Agent, or Firm*—Dressler, Goldsmith, Shore, Sutker & Milnamow, Ltd.

[57] ABSTRACT

A door-operating mechanism is disclosed which is particularly suited for use with hingedly mounted swinging glass doors of a refrigerated display cabinet. The door operating mechanism includes an extensible gas spring biased toward an extended condition, and a linkage arrangement operatively interconnecting the gas spring with the door. A portion of the gas spring is movably disposed within a slot defined by the linkage arrangement such that in one position of the gas spring the door is biased toward its closed position, and in another position of the gas spring the door may be maintained in an opened position such as for stocking or maintenance of the display cabinet.

15 Claims, 8 Drawing Figures

DOOR OPERATING MECHANISM

TECHNICAL FIELD

The present invention relates generally to mechanisms for controlling movement of a swinging door, and more particularly to an improved door operating mechanism for a door of a refrigerated display cabinet which normally biases the door toward a closed position but which may be manipulated to releasably maintain the door in an open position.

BACKGROUND OF THE INVENTION

Refrigerated display cabinets are widely used in supermarkets and the like for storage and display of refrigerated and frozen food items. These cabinets typically include one or more hingedly mounted, swinging insulated glass doors, these doors effecting insulated closure of the cabinet and affording ready selection of food items in the cabinet by a shopper.

So that the glass doors of the display cabinet are not inadvertently left open, and in order to effect sealing engagement of the doors with the door frame of the cabinet, each door is preferably provided with a self-closing arrangement for biasing the door toward a closed position. However, because there are certain instances during which it is desirable for the door to be maintained in an open position, such as during stocking of the display cabinet shelves or during maintenance, the provision of a hold-open mechanism for overriding the self-closing arrangement of the door is a particularly desirable feature.

In the past, self-closing arrangements have typically included one or more spring-loading mechanisms associated with the upper and lower hinge assemblies of the door. Hold-open mechanisms for doors of this type usually have included an abutment member movably mounted on the door frame which is adapted to positively engage and abut a portion of the door when it is in its opened position to prevent it from closing.

While spring-loading, self-closing mechanisms of the above type have proved effective in providing this function, hold-open mechanisms as described have several drawbacks. Specifically, should the door of the refrigerated cabinet be inadvertently moved toward its closed position while being maintained in its opened position by the hold-open mechanism, the nature of the non-yielding, positive engagement of the door with the mechanism may result in damage to the door or the mechanism. At the worst, the insulated glass of the door may be broken, this result of course being extremely undesirable.

Thus, the provision of a hold-open mechanism which is adapted to maintain the door of the refrigerated cabinet in an opened position when desired, yet which is self-releasing so as to automatically disengage the door when the door is moved with sufficient force would provide a significantly improved arrangement for holding the doors open when desired. Additionally, the incorporation of such a hold-open device in a self-closing mechanism for the door would provide a single operating mechanism which would provide both of these desired functions.

SUMMARY OF THE INVENTION

In accordance with the present invention, a door operating mechanism is disclosed which is particularly suited for use with an insulated door hingedly connected for swinging movement to a door frame of a refrigerated display cabinet.

The hold-open mechanism includes an extensible spring arrangement biased to an extended condition connected to the door frame. In the preferred embodiment, the spring arrangement comprises a so-called gas spring, which includes a gas pressurized cylinder within which a piston is reciprocably movable and biased toward an extended condition.

The operating mechanism further includes a linkage arrangement operatively connecting the door with the spring arrangement. The linkage includes hold-open means whereby the spring arrangement is movable from a first position wherein the door is biased to its closed position, to a second position when the door is in its opened position wherein the spring is adapted to releasably hold the door in the open position.

The hold-open means of the present invention comprise a slot defined by the linkage operatively connecting the door and the spring arrangement. The spring includes a portion movably disposed within the slot so that disposition of the spring portion in a first portion of the slot biases the door to its closed position, and disposition of the spring portion in a second portion of the slot when the door is opened maintains the door in its opened position.

In one embodiment of the present invention, the linkage arrangement includes a link fixed to the door which defines the slot in a portion spaced from the door. In an alternate embodiment, the linkage arrangement includes a first link pivotally mounted to the door frame which defines the hold-open slot, and a second link extending between and respectively pivotally connected with the first link and the door. Stop means are provided on one of the first and second links for limiting open movement of the door.

Numerous other advantages and features of the present invention will become readily apparent from the following detailed description of the invention and the embodiments thereof, from the claims and from the accompanying drawings which like numerals are employed to designate like parts throughout the same.

DETAILED DESCRIPTION

Figure 1:
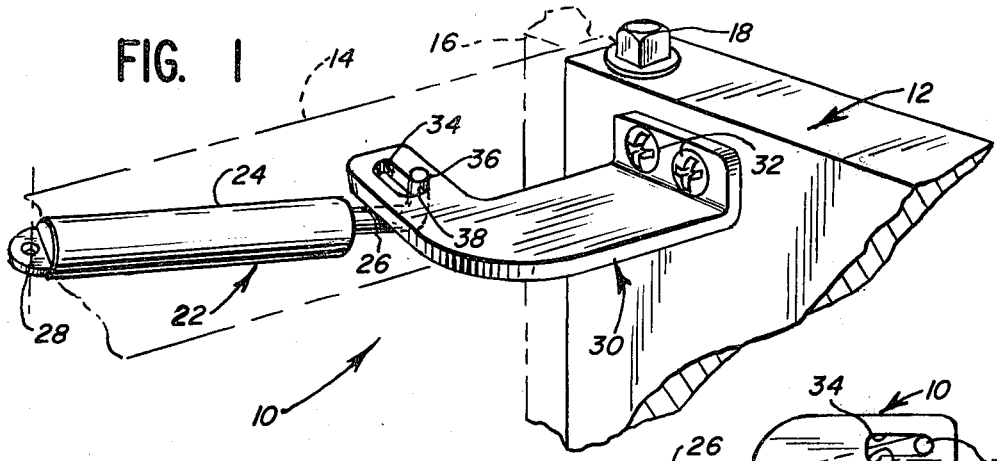
FIG. 1 is a partial perspective view of the door operating mechanism of the present invention.

While the present invention is susceptible to embodiment in different forms, there is shown in the drawings and will hereinafter be described a presently preferred embodiment and an alternate embodiment with the understanding that the present disclosure is to be considered as an exemplification of the principles of the invention and is not intended to limit the invention to the embodiments illustrated.

With reference now to FIG. 1, therein is illustrated the door operating mechanism 10 incorporating the present invention. While the operating mechanism 10 will be discussed with reference to the components of a refrigerated display cabinet for purposes of illustration, it will be understood that the mechanism would be equally suited for use with other hingedly mounted door arrangements.

As illustrated, mechanism 10 is shown in association with a display cabinet including a door 12 hingedly mounted for swinging movement between opened and closed positions with respect to the door frame of the cabinet. The frame includes a horizontal frame member 14, and a vertical column member or mullion 16 extending downwardly from frame member 14. A hinge pin 18 extends upwardly from door 12 and defines the swinging axis of the door, and is adapted to be received by a hinge assembly (not shown) on the door frame. Handle 20 is provided on the front of door 12 for opening and closing the door.

While operating mechanism 10 is illustrated as positioned near the top of door 12 and its supporting door frame, the mechanism may easily be mounted near the bottom of the door, with consideration being given to ease of operation and positioning in an out-of-the-way location.

As shown, operating mechanism 10 includes a gas spring 22. Gas spring 22 is of the type which is biased toward an extended condition, and includes a gas pressurized cylinder 24, and a piston 26 reciprocably disposed within cylinder 24. Gas springs of this type usually include a dampening valving arrangement of some nature so that the reciprocation of the piston is controlled. These type of springs operate to bias the piston outwardly of the cylinder to an extended condition due to the difference in surface area between the piston rod side of the piston surface and the cylinder side of the piston surface. One source of gas springs of this nature is Gas Spring Corporation, Colmar, Pennsylvania.

Gas spring 22 is mounted to frame member 14 of the door frame at pivotal connection 28. The gas spring extends from pivotal connection 28 to a generally L-shaped link 30 mounted on door 12 by mechanical fasteners 32. The gas spring is operatively connected with link 30 by means of a slot 34 defined by the link. An upturned portion 36 of piston 26 of the gas spring is movably disposed in slot 34 so that it may be selectively positioned at either end portion of the slot as will be described. Slot 34 includes a detent 38, or other suitable indentation, at one end thereof which cooperates with upturned portion 36 of piston 26 to operate the door 12 in the following fashion.

Figure 2:
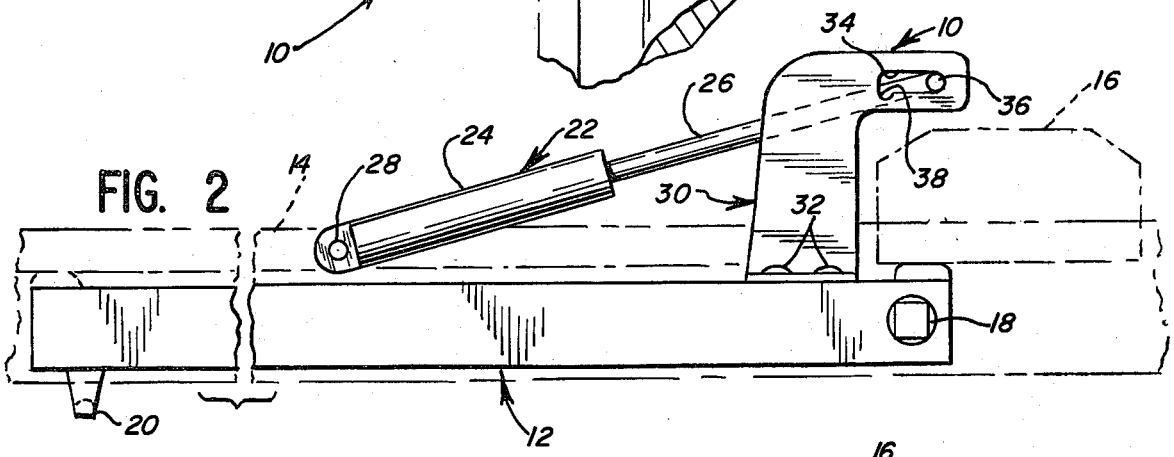
FIG. 2 is a plan view of the door operating mechanism of FIG. 1 shown with the door in the closed position.

As shown in FIG. 2, door 12 is in its closed position, with upturned portion 36 of gas spring piston 26 disposed in slot 34 as shown. With portion 36 disposed in this portion of slot 34, the extensibly biasing nature of the gas spring 22 urges door 12 into sealing engagement with the door frame, and firmly maintains door 12 in its closed position.

Figure 3:
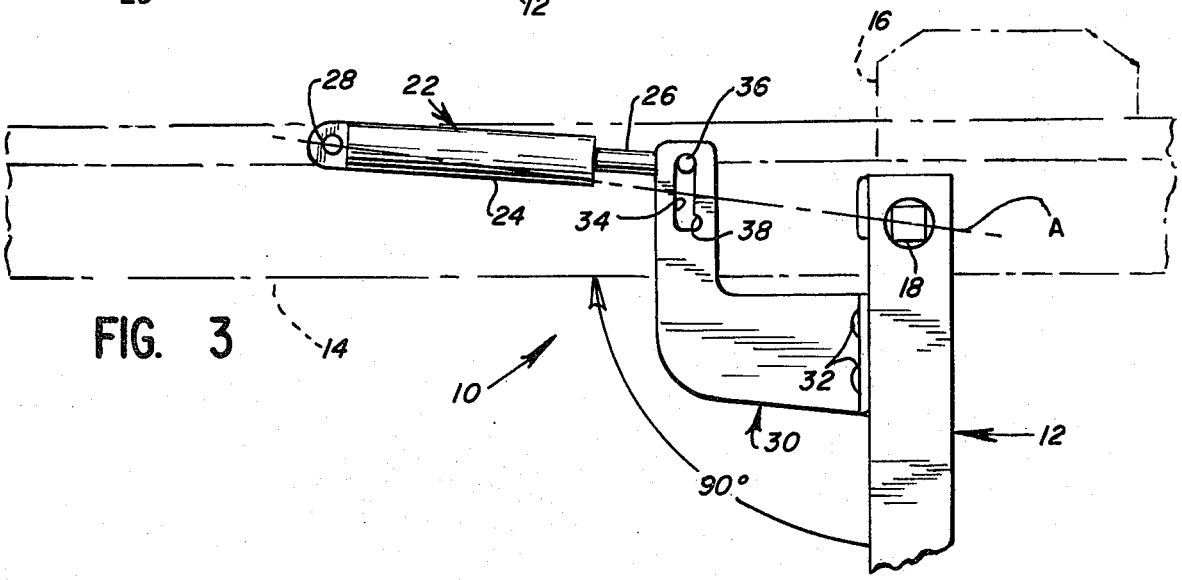
FIG. 3 is a plan view of the door operating mechanism illustrated in FIG. 1 showing the door in its opened position.
Figure 4:
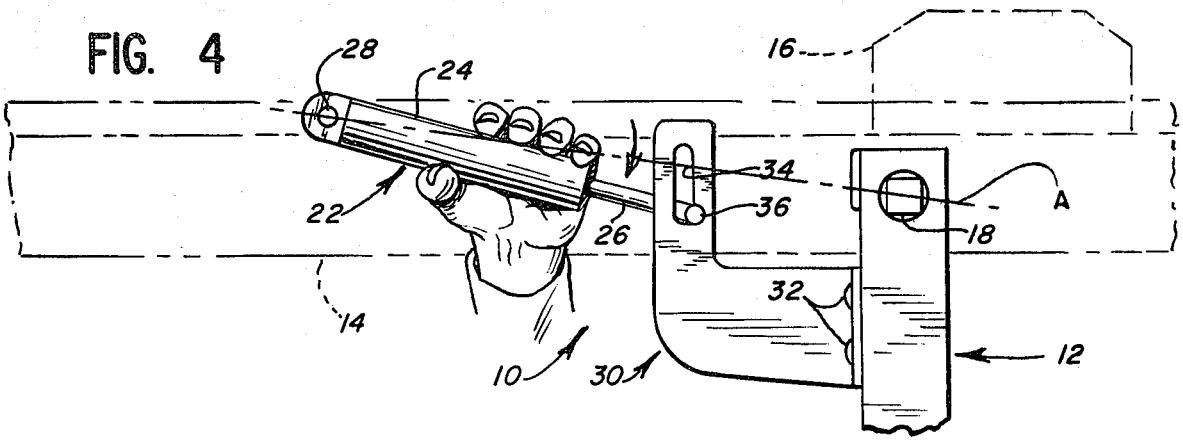
FIG. 4 is a plan view of the door operating mechanism of FIG. 1 showing the door releasably maintained in its opened position.
Figure 5:
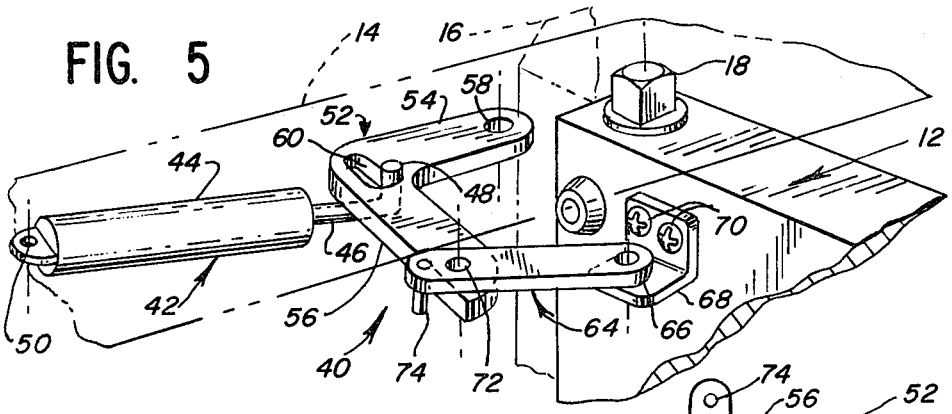
FIG. 5 is a partial perspective view of an alternate embodiment of the door operating mechanism of the present invention.

As door 12 is swung open to the position shown in FIG. 3, the interaction of link 30 and gas spring 22 urges gas spring piston 26 into cylinder 24 against the biasing action of the spring. Thus, in this position of the door, gas spring 22 continually biases the door toward its closed position. This would be the normal operating mode of the door so that a shopper may conveniently open door 12 to reach into the refrigerated display cabinet, with the door automatically closing after the shopper releases it. Although not shown, a stop mechanism, such as an upstanding pin or the like, is typically provided associated with the door and the door frame. The stop mechanism operates to limit opening movement of door 12 past approximately 90 degrees with respect to the door frame, thus avoiding interference of adjacent doors with each other.

Line A shown in FIG. 3 is defined by the swinging axis of door 12 and the pivotal connection 28 of gas spring 22 to frame member 14. It will be noted that the longitudinal centerline or line of biasing action of gas spring 22, extending between pivotal connection 28 and the end portion of piston 26, is disposed inwardly of line A (with respect to the door frame). It will be appreciated that whenever this relationship exists between the components of the operating mechanism, door 12 will be biased toward its closed position since a clockwise moment (as viewed in FIG. 3) is exerted on the door by the gas spring about the door's hinging axis. It should also be noted that the L-shaped configuration of link 30 spaces slot 34 from door 12 to provide this moment arm, yet accommodates ready clearance of mullion 16 of the door frame by operating mechanism 10 when door 12 is closed (see FIG. 2).

During those periods when it is desired to maintain door 12 in its opened position, such as during stocking of the shelves of the display cabinet, operating mechanism 10 provides this function in an extremely simple manner. Door 12 is first moved to its fully opened position, as shown in FIG. 3. Stock personnel may then easily grasp gas spring 22 and pull it outwardly of the door frame so that upturned portion 36 of piston 26 is moved to the end portion of slot 34 which includes detent 38. With gas spring 22 in this position, the line of its biasing action is disposed outwardly of line A, and thus a moment is exerted on door 12 about its hinging axis to maintain the door in its open position. It will be appreciated that manipulation of gas spring 22 so that operating mechanism 10 provides this hold-open function is easy and straightforward. Stocking or maintenance of a display cabinet may now be performed with door 12 firmly maintained in its opened position.

When it is desired to return operation mechanism 10 to its normal door closing position, this may be achieved in an essentially automatic fashion. Specifically, door 12 is simply moved to close it. When door 12 is moved with sufficient force, gas spring 22 is caused to compress. As the door is moved and the gas spring continues to compress, a point is reached at which upturned portion 36 of piston 26 disengages from and slips out of detent 38 in slot 34. As this occurs, the gas spring automatically extends and reorients itself so that portion 36 is again disposed in the end of slot 34 opposite detent 38. As discussed above, this disposition of gas spring 22 relative to link 30 directs the biasing action of the gas spring so that the moment exerted on door 12 acts to firmly close the door and seal the cabinet. Significantly, the releasable retention of door 12 in its open position, and self-releasing nature of operating mechanism 10 during the hold-open mode provides a significant advance over the positively engaging, non-yielding hold-open mechanisms heretofore known where inadvertent closing movement of the door could damage the door or the hold-open mechanism.

With reference now to FIGS. 5–8, therein is illustrated an alternate embodiment of the door operating mechanism of the present invention. Operating mechanism 40 is shown in conjunction with hingedly mounted door 12 and frame member 14 and mullion 16. Operating mechanism 40 functions in a fashion similar to operating mechanism 10 described above, but as will be noted by comparing FIGS. 2 and 6, mechanism 40 provides this operation without portions of the mechanism moving in the area inwardly of mullion 16. This feature of this embodiment of the present invention is desirable for use with display cabinets where shelving supports or other members disposed adjacent to and inwardly of mullion 16 must be cleared by the door operating mechanism during movement of the door between closed and opened positions.

In this embodiment, a gas spring 42 is shown including a gas pressurized cylinder 44 and a reciprocably movable piston 46 disposed therein. The piston 46 includes an upturned portion 48, and the gas spring 42 is pivotally mounted on frame member 14 of the door frame at pivotal connection 50. The pressurized gas in cylinder 44 biases piston 46 to an extended condition.

Operating mechanism 40 further includes a first link 52. Link 52 has a generally L-shaped configuration, and includes a pair of angularly disposed legs 54 and 56. Link 52 is mounted to frame member 14 at one end of leg 54 by pivotal connection 58. An intermediate portion of link 52 defines an elongated slot 60 which includes a detent or other indentation 62 at one end portion thereof.

Operating mechanism 40 further includes a second link 54 which extends between and is respectively pivotally connected with the link 52 and door 12. The pivotal connection 66 connects one end of link 64 with a flange 68 affixed to door 12 by mechanical fasteners 70. The other end of link 64 is pivotally connected at 72 with an end of leg 56 of link 52. A stop may be provided on one of links 52 and 64 for engagement with the other of the links to limit the opening movement of door 12. A suitable stop pin 74 is shown provided on link 64 for engagement with link 52 to prevent door 12 from moving past an opened position of approximately 90 degrees with respect to the door frame.

Figure 6:
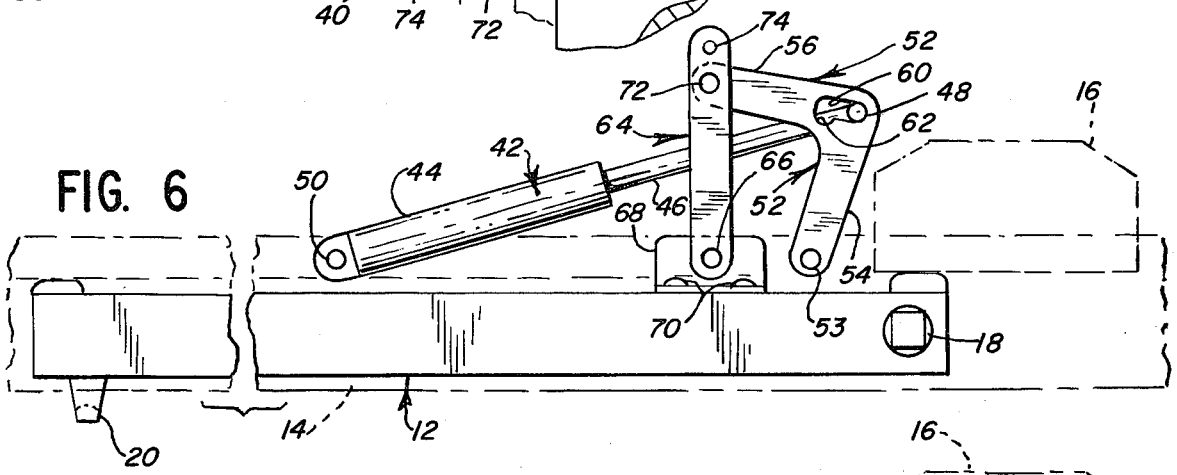
FIG. 6 is a plan view of the door operating mechanism of FIG. 5 showing the door in the closed position.

Door operating mechanism 40 functions in a fashion similar to operating mechanism 10 described above, but as noted mechanism 40 easily clears mullion 16 of door frame when door 12 is in its closed position, as shown in FIG. 6. In this position of the door, gas spring 42 is shown biased to its extended condition so that it acts through links 52 and 64 to firmly maintain door 12 in its closed position and effect sealing of the display cabinet.

Figure 7:
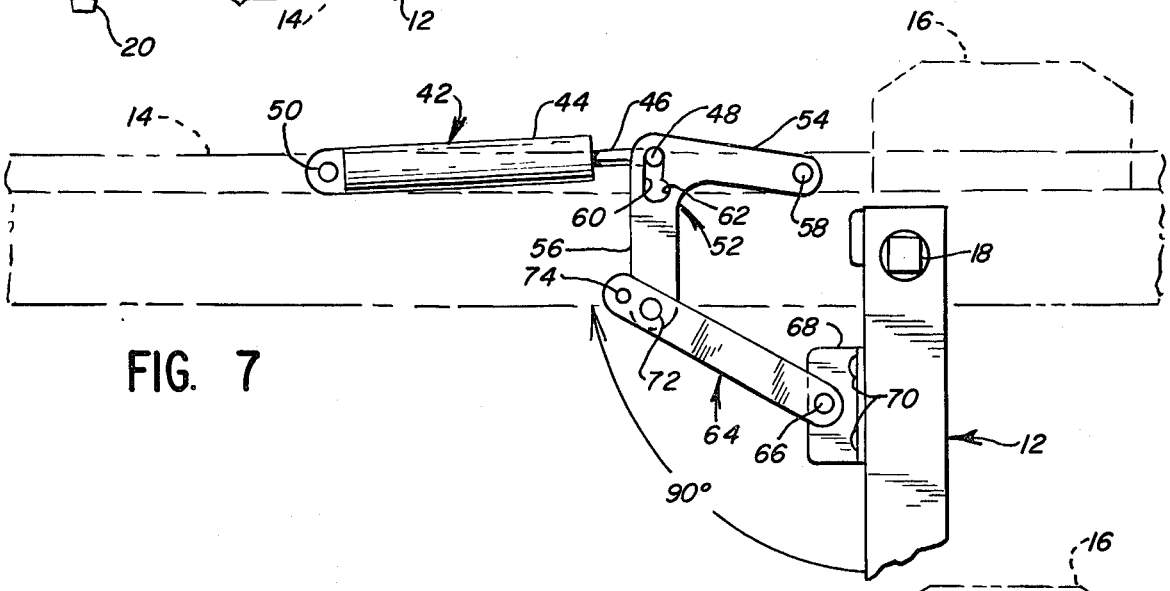
FIG. 7 is a plan view of the door operating mechanism of FIG. 5 showing the door in an opened position.

Normal opening movement of door 12 is illustrated in FIG. 7, wherein the opening movement of the door has compressed gas spring 42 through the action of links 64 and 52. Upturned portion 48 of piston 46 remains disposed in a portion of slot 60 opposite detent 62. Notably, the line of biasing action of gas spring 42, as described above, is disposed inwardly of a line defined by gas spring pivotal connection 50 and first link pivotal connection 58. Thus, during normal operation of the door by mechanism 40 this relationship would always exist so that a clockwise moment (as viewed in the FIGS. 6–8) is exerted on link 52, thus biasing door 12 toward its closed position. Engagement of stop pin 74 with link 52 when the door is in its fully opened position limits opening movement of the door.

After the door is released when operating mechansim 40 is in the self-closing mode, the action of gas spring 42 automatically closes the door.

Figure 8:
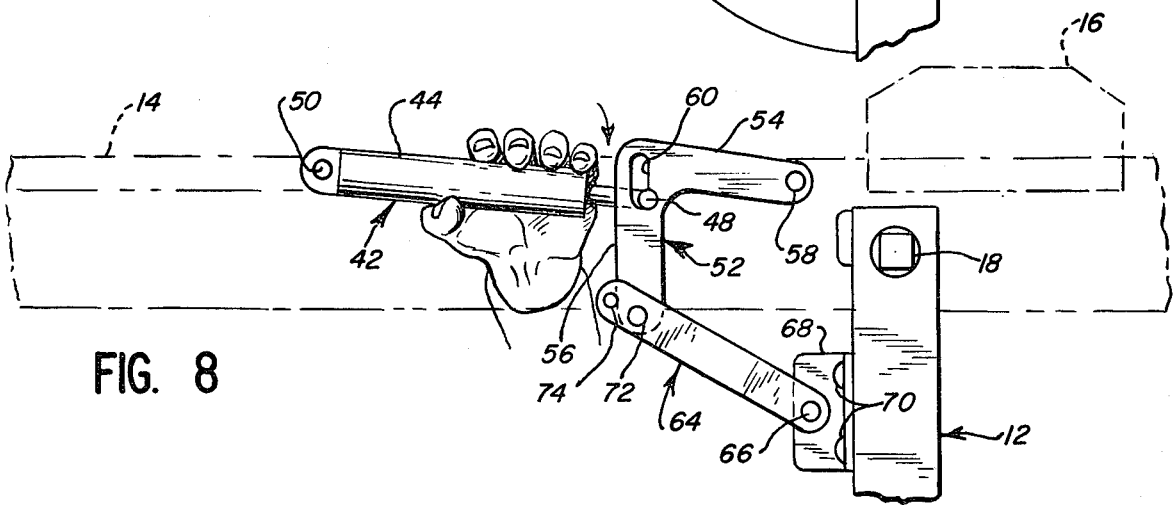
FIG. 8 is a plan view of the door operating mechanism of FIG. 5 showing the door releasably maintained in the opened position.

As shown in FIG. 8, manipulation of mechanism 40 from its normal closing mode to its door hold-open mode is accomplished as described above. Personnel wishing to maintain door 12 in its open position merely grasp gas spring 42 and pull it outwardly of frame member 14 so that upturned portion 48 of piston 46 is moved within slot 60 to detent 62. In this position, the line of biasing action of gas spring 42 is disposed outwardly of the line defined by pivotal connections 50 and 58, and thus the moment exerted on link 52 releasably maintains door 12 in its opened position.

After stocking or maintenance of the display cabinet is completed, mechanism 40 is automatically disengaged from the hold-open mode by simply moving door 12 with sufficient force toward its closed position. As gas spring 42 is compressed by this closing of door 12, upturned portion 48 disengages and slips out of detent 62 and moves to the opposite end of slot 60. When this occurs, gas spring 42 again biases links 52 and 64 so that door 12 is again self-closing. As noted, this novel self-releasing nature of operating mechanism 40 avoids damage to the display cabinet which may occur with inadvertent closing of a door maintained in its opened position by a positive engagement hold-open mechanism.

Thus, a novel door operating mechanism is disclosed for operating a hingedly mounted swinging door which provides combination self-closing and hold-open functions in a novel fashion. From the foregoing, it will be observed that numerous variations and modifications may be effected without departing from the true spirit and scope of the novel concept of the present invention. It will be understood that no limitations with respect to the specific embodiments illustrated herein is intended or should be inferred. It is, of course, intended to cover by the appended claims all such modifications as fall within the scope of the claims.

What is claimed is:

1. A door operating mechanism for use with a door hingedly connected to a door frame for swinging movement with respect thereto between opened and closed positions, comprising:

extensible spring means biased towards an extended condition connected to said frame, and linkage means operatively connecting said door and said spring means, and including hold-open means operative to permit said spring means to be selectively moved, when said door is in said opened position, from a first position wherein said door is biased to the closed position to a second position wherein said spring means bias said door toward said opened position to releasably hold the door in the opened position.

2. A door operating mechanism in accordance with claim 1, wherein said spring means comprises a gas spring including an extensible piston movable within a pressurized cylinder, said piston being biased by pressurized gas towards an extended position relative to said cylinder.

3. A door operating mechanism in accordance with claim 1, wherein said hold-open means comprise slot means defined by said linkage means, the operative connection of said spring means with a first portion of said slot means biasing said door to said closed position, and the operative connection of said spring means with a second portion of said slot means when said door is in an open position releasably maintaining said door in said open position.

4. A door operating mechanism in accordance with claim 3, wherein said linkage means comprise a first link pivotally connected to said frame and defining said slot means, and a second link extending between and respectively pivotally connected with said first link and said door.

5. A door operating mechanism in accordance with claim 4, wherein said linkage means further includes steps means for limiting said opening swinging movement of said door.

6. A door operating mechanism in accordance with claim 5, wherein said stop means comprise a stop fixed to one of said first and second links engageable with the other of said links.

7. A door operating mechanism in accordance with claim 4, wherein said first link includes a pair of legs disposed angularly with respect to each other, the end portion of one leg being pivotally connected to said frame, the end portion of the other leg being pivotally connected to said second link, said slot means being defined by an intermediate portion of said first link.

8. A door operating mechanism in accordance with claim 3, wherein said linkage means comprise a link affixed to said door and having a portion spaced from said door defining said slot means.

9. A door operating mechanism in accordance with claims 3 or 8, wherein said spring means defines a line of biasing force and includes a pivotal connection to said frame at a position so that said line of biasing force is disposed inwardly of a line between said pivotal connection and the swinging axis of said door when said spring means is operatively connected to said first portion of said slot means, and said line of biasing force is disposed outwardly of said line between said pivotal connection and the swinging axis of said door when said spring means is operatively connected to said second portion of said slot means.

10. A door operating mechanism in accordance with claim 8, wherein said spring means include a pressurized gas spring having a portion movably disposed in said slot means.

11. A door operating mechanism in accordance with claims 8, 10 or 4, wherein said second portion of said slot means includes detent means whereby said spring means is releasably maintained in operative connection with said second portion until said door is substantially moved toward said closed position.

12. A door operating mechanism for use with a door hingedly connected to a door frame for swinging movement with respect thereto between opened and closed positions, comprising:

extensible spring means connected to said frame and biased toward an extended condition, linkage means operatively connecting said door and said spring means comprising a link affixed to said door and defining an elongated slot spaced from said door, said spring means having an end portion selectively positionable in said slot when said door is in said opened position, so that when said end portion of said spring means is disposed in a first portion of said slot said spring means is operative to bias said door toward said closed position, and when said end portion of said spring means is disposed in a second portion of said slot said spring means is operative to bias said door toward said opened position to releasably maintain said door in said opened position.

13. A door operating mechanism is accordance with claim 12, wherein said second portion of said slot includes detent means whereby when said end portion of said spring is in said second portion, said end portion is adapted to be automatically moved from said second portion when said door is substantially moved from said opened position.

14. A door operating mechanism for use with a door hingedly connected to a door frame for swinging movement with respect thereto between opened and closed positions, comprising:

a first link pivotally connected to said frame, a second link extending between and respectively pivotally connected to said first link and said door, extensible spring means extending between said frame and said first link and biased toward an extended condition, said spring means including an end portion selectively positionable in slot means defined by said first link when said door is in said opened position, so that when said end portion of said spring means is disposed in a first portion of said slot means said spring means is operative to bias said door toward said closed position, and when said spring portion is disposed in a second portion of said slot means said spring means is operative to bias said door toward said opened position to releasably maintain said door in the opened position until substantial movement of the door from the opened position moves said spring portion from said second portion of said slot means.

15. A door operating mechanism in accordance with claim 14, and stop means on one of said first and second links engageable with the other of said links whereby opening swinging movement of said door is limited.

* * * * *